US010220925B1

(12) United States Patent
Pelini

(10) Patent No.: US 10,220,925 B1
(45) Date of Patent: Mar. 5, 2019

(54) HYDRAULIC TILT AND TRIM DEVICE

(71) Applicant: Mark F. Pelini, Valrico, FL (US)

(72) Inventor: Mark F. Pelini, Valrico, FL (US)

( * ) Notice: Subject to any disclaimer, the term of this patent is extended or adjusted under 35 U.S.C. 154(b) by 0 days.

(21) Appl. No.: 15/820,066

(22) Filed: Nov. 21, 2017

(51) Int. Cl.
*B63H 20/10* (2006.01)
*F15B 11/10* (2006.01)
*B63H 20/06* (2006.01)

(52) U.S. Cl.
CPC ..... *B63H 20/10* (2013.01); *B63H 20/06* (2013.01); *F15B 11/10* (2013.01); *F15B 2211/20515* (2013.01)

(58) Field of Classification Search
CPC ..... B63H 20/10; B63H 20/06; F15B 11/10; F15B 2211/20515
USPC ..... 248/640, 641, 642, 643
See application file for complete search history.

(56) References Cited

U.S. PATENT DOCUMENTS 5,782,662 A * 7/1998 Icenogle ..... B63H 20/106 248/641
5,934,955 A * 8/1999 Heston ..... B63H 20/10 440/57
5,944,568 A * 8/1999 Rabal ..... B63H 20/106 440/53
6,126,498 A 10/2000 Icenogle
7,390,231 B1 * 6/2008 Pelini ..... B63H 21/14 440/61 E
7,416,459 B1 * 8/2008 Pelini ..... B63H 20/106 440/61 R
7,513,810 B1 * 4/2009 Pelini ..... B63H 20/10 440/61 R
7,731,552 B1 * 6/2010 Pelini ..... B63H 20/06 440/53
8,216,009 B1 * 7/2012 Pelini ..... B63H 20/08 248/640
8,267,025 B2 * 9/2012 Witte ..... B63H 20/106 114/53
8,535,105 B1 * 9/2013 Pelini ..... B63H 20/02 440/61 E
8,657,637 B1 * 2/2014 Pelini ..... B63H 20/106 440/53
9,004,962 B1 * 4/2015 Pelini ..... B63H 20/10 440/61 D

* cited by examiner

*Primary Examiner* — Muhammad Ijaz
(74) *Attorney, Agent, or Firm* — Edward P. Dutkiewicz

(57) ABSTRACT

There is a transom portion with a transom plate and two extensions. There is a motor portion with a motor plate and two extensions. The transom portion and motor portion are pivotably coupled. The transom portion has a hydraulic cylinder base support bracket. The motor portion has a hydraulic cylinder ram support bracket. There is a hydraulic cylinder having a base and a ram. There is an electric hydraulic pump, the electric hydraulic pump being operatively coupled to the hydraulic cylinder.

8 Claims, 3 Drawing Sheets

HYDRAULIC TILT AND TRIM DEVICE

BACKGROUND OF THE INVENTION

Rule 1.78 (F)(1) Disclosure

The Applicant has not submitted a related pending or patented non-provisional application within two months of the filing date of this present application. The invention is made by a single inventor, so there are no other inventors to be disclosed. This application is not under assignment to any other person or entity at this time.

FIELD OF THE INVENTION

The present invention relates to a hydraulic tilt and trim device and more particularly pertains to a device for tilting an outboard motor.

DESCRIPTION OF THE PRIOR ART

The use of jack plates is known in the prior art. More specifically, jack plates previously devised and utilized for the purpose of allowing a user to position an outboard boat motor are known to consist basically of familiar, expected, and obvious structural configurations, notwithstanding the number of designs encompassed by the prior art which has been developed for the fulfillment of countless objectives and requirements.

While the prior art devices fulfill their respective, particular objectives and requirements, the prior art does not describe hydraulic tilt and trim device that allows a user to tilt a jack plate hydraulically.

In this respect, the hydraulic tilt and trim device according to the present invention substantially departs from the conventional concepts and designs of the prior art, and in doing so provides an apparatus primarily developed for the purpose of a device for tilting and trimming an outboard motor.

Therefore, it can be appreciated that there exists a continuing need for a new and improved hydraulic tilt and trim device which can be used for tilting a jack plate which holds an outboard motor. In this regard, the present invention substantially fulfills this need.

SUMMARY OF THE INVENTION

In view of the foregoing disadvantages inherent in the known types of jack plates now present in the prior art, the present invention provides an improved hydraulic tilt and trim device. As such, the general purpose of the present invention, which will be described subsequently in greater detail, is to provide a new and improved hydraulic tilt and trim device which has all the advantages of the prior art and none of the disadvantages.

In describing this invention, the word "coupled" is used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another.

By adjacent to a structure is meant that the location is near the identified structure.

To attain this, the present invention essentially comprises a hydraulic tilt and trim device, comprising several components, in combination.

There is a transom portion. The transom portion is fabricated of rigid material. The transom portion has a transom plate. The transom plate has a generally flat rectilinear configuration. The transom plate has a transom surface and a rearward surface, with a thickness there between. The transom plate has an upper end and a lower end. The transom plate upper end and transom plate lower end are continuous. The transom plate has a plurality of transom mounting holes there through. The transom plate has a plurality of hydraulic cylinder base support bracket mounting holes there through. The transom portion has generally C-shaped configuration. The transom portion has two oppositely located rearward extensions. The rearward extensions of the transom portion each have an upper end and a lower end. The upper end of each rearward extension and the lower end of each rearward extension are continuous. Each rearward extension upper end has a pivot hole there through, with there being an associated pivot bolt for each rearward extension upper end pivot hole. Each pivot bolt has an associated pivot bolt nut and an associated pivot bolt spacer.

There is a hydraulic cylinder base support bracket. The hydraulic cylinder base support bracket is fabricated of rigid material. The hydraulic cylinder base support bracket has a transom plate rearward surface mount and a pair of rearwardly disposed mounting tabs. The hydraulic cylinder base support bracket transom plate rearward surface mount has a plurality of threaded mounting holes there through. Each of the mounting holes through the hydraulic cylinder base support bracket transom plate rearward surface mount has an associated hydraulic cylinder base support bracket rearward surface mount bolt.

There is a motor portion. The motor portion is fabricated of rigid material. The motor portion has a motor plate. The motor plate has a generally flat rectilinear configuration. The motor plate has a motor surface and a forward surface, with a thickness there between. The motor plate has an upper end and a lower end. The motor plate upper end and motor plate lower end are continuous. The motor plate has a plurality of hydraulic cylinder ram support mounting holes there through. The motor portion has a generally C-shaped configuration. The motor portion has two oppositely located forward extensions. The forward extensions of the motor portion each has an upper end and a lower end. The upper end of the forward extensions of the motor portion and lower end of the forward extensions of the motor portion are continuous. Each forward extension upper end has a pivot hole there through which is sized to receive the pivot bolt.

There is a hydraulic cylinder ram support bracket. The hydraulic cylinder ram support bracket is fabricated of rigid material. The hydraulic cylinder ram support bracket has a motor plate forward surface mount and a pair of forwardly disposed mounting tabs. The hydraulic cylinder ram support motor plate forward surface mount has a plurality of threaded mounting holes there through. Each of the mounting holes through the hydraulic cylinder ram support motor plate forward surface mount has an associated hydraulic cylinder ram support forward surface mount bolt.

There is a hydraulic cylinder. The hydraulic cylinder has a base and a ram. The ram has a ram pin hole there through. The hydraulic cylinder ram is coupled to the hydraulic cylinder ram support bracket. The hydraulic cylinder base is coupled to the hydraulic cylinder base support bracket.

There is a ram bushing. The ram bushing has a rectangular tubular configuration with a ram pin hole there through.

Lastly, there is an electric hydraulic pump. The electric hydraulic pump has an associated reservoir contained therein. The electric hydraulic pump has a power source line. The electric hydraulic pump is operatively coupled to the hydraulic cylinder.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hydraulic tilt and trim device which has all of the advantages of the prior art devices and none of the disadvantages.

It is another object of the present invention to provide a new and improved hydraulic tilt and trim device which may be easily and efficiently manufactured and marketed.

It is further object of the present invention to provide a new and improved hydraulic tilt and trim device which is of durable and reliable constructions.

An even further object of the present invention is to provide a new and improved hydraulic tilt and trim device which is susceptible of a low cost of manufacture with regard to both materials and labor, and which accordingly is then susceptible of low prices of sale to the consuming public, thereby making such hydraulic tilt and trim device economically available to the buying public.

Even still another object of the present invention is to provide a hydraulic tilt and trim device for allowing a user to be able to tilt an outboard motor.

Lastly, it is an object of the present invention to provide a new and improved hydraulic tilt and trim device having transom portion with a transom plate and two extensions. There is a motor portion with a motor plate and two extensions. The transom portion and motor portion are pivotably coupled. The transom portion has a hydraulic cylinder base support bracket. The motor portion has a hydraulic cylinder ram support bracket. There is a hydraulic cylinder having a base and a ram. There is an electric hydraulic pump, the electric hydraulic pump being operatively coupled to the hydraulic cylinder.

It should understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout. the various Figures.

DESCRIPTION OF THE PREFERRED EMBODIMENT

Figure 1:
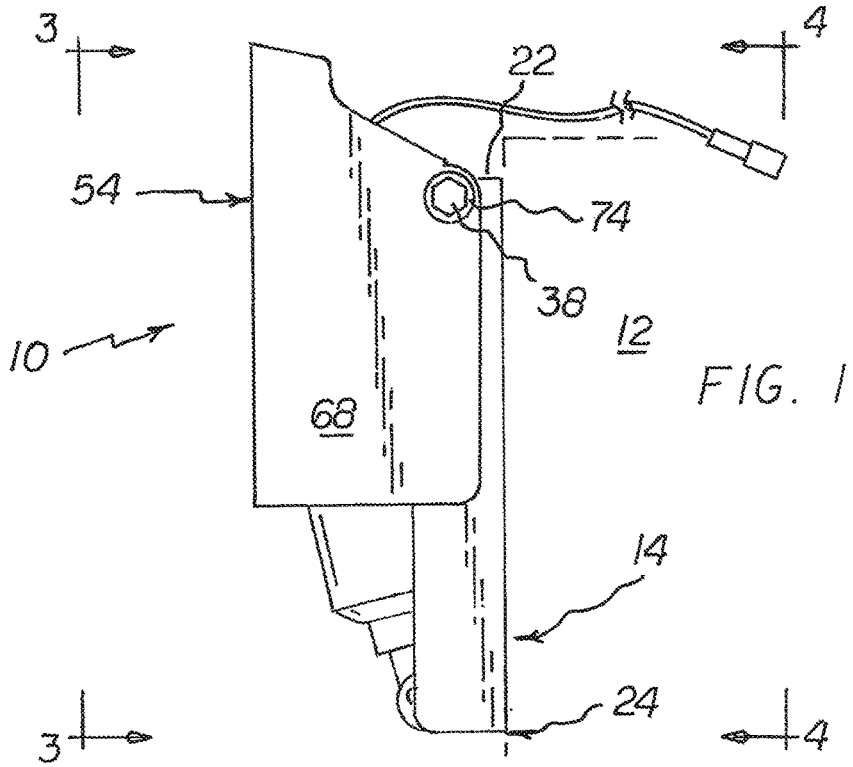
FIG. 1 is a right side elevational view of the invention in the running orientation.

With reference now to the drawings, and in particular to FIG. 1 thereof, the preferred embodiment of the new and improved hydraulic tilt jack plate embodying the principles and concepts of the present invention and generally designated by the reference numeral 10 will be described.

The present invention, the hydraulic tilt and trim device 10 is comprised of a plurality of components. Such components in their broadest context include a transom portion, a motor portion, a set of mounting brackets and a hydraulic cylinder. Such components are individually configured and correlated with respect to each other so as to attain the desired objective.

A hydraulic tilt and trim device 10, comprising several components, in combination, is herein described.

There is an existing boat transom 12.

There is a transom portion 14. The transom portion is fabricated of rigid material. The transom portion has a transom plate 16. The transom plate has a generally flat rectilinear configuration. The transom plate has a transom surface 18 and a rearward surface 20, with a thickness there between.

The transom plate 22 has an upper end and a lower end 24. The transom plate upper end and transom plate lower end are continuous. The transom plate has a plurality of transom mounting holes 26 there through. The transom plate has a plurality of hydraulic cylinder base support bracket mounting holes 28 there through. The transom portion has a generally C-shaped configuration. The transom portion has two oppositely located rearward extensions 30. The rearward extensions of the transom portion each have an upper end 32 and a lower end 34. The upper end of each rearward extension and the lower end of each rearward extension are continuous. Each rearward extension upper end has a pivot hole 36 there through, with there being an associated pivot bolt 38 for each rearward extension upper end pivot hole. Each pivot bolt has an associated pivot bolt nut 40 and an associated pivot bolt spacer 42.

There is a hydraulic cylinder base support bracket 44. The hydraulic cylinder base support bracket is fabricated of rigid material. The hydraulic cylinder base support bracket has a transom plate rearward surface mount 46 and a pair of rearwardly disposed mounting tabs 48. The hydraulic cylinder base support bracket transom plate rearward surface mount has a plurality of threaded mounting holes 50 there through. Each of the mounting holes through the hydraulic cylinder base support bracket transom plate rearward surface mount has an associated hydraulic cylinder base support bracket rearward surface mount bolt 52.

There is a motor portion 54. The motor portion is fabricated of rigid material. The motor portion has a motor plate 56. The motor plate has a generally flat rectilinear configuration. The motor plate has a first surface being a motor surface 58 which a outboard motor mounts to and a second surface being a forward surface 60 which is opposite the motor surface and is oriented in a forward direction, with a thickness there between.

The motor plate comprising the first motor surface and the second forward surface has an upper end 62 and a lower end 64. The motor plate upper end and motor plate lower end are continuous. The motor plate has a plurality of hydraulic cylinder ram support mounting holes 66 there through. The motor portion has a generally C-shaped configuration. The motor portion has two oppositely located forward extensions 68. The forward extensions of the motor portion each has an upper end 70 and a lower end 72. The upper end of the forward extensions of the motor portion and lower end of the forward extensions of the motor portion are continuous. Each forward extension upper end has a pivot hole 74 there through which is sized to receive the pivot bolt.

There is a hydraulic cylinder ram support bracket 76. The hydraulic cylinder ram support bracket is fabricated of rigid material. The hydraulic cylinder ram support bracket has a motor plate forward surface mount 78 and a pair of forwardly disposed mounting tabs 80. The hydraulic cylinder ram support motor plate forward surface mount has a plurality of threaded mounting holes 82 there through. Each of the mounting holes through the hydraulic cylinder ram support motor plate forward surface mount has an associated hydraulic cylinder ram support forward surface mount bolt 84.

There is a hydraulic cylinder 86. The hydraulic cylinder has a base 88 and a ram 90. The ram has a ram pin hole 92 there through. The hydraulic cylinder ram is coupled to the hydraulic cylinder ram support bracket. The hydraulic cylinder base is coupled to the hydraulic cylinder base support bracket.

There is a ram bushing 94. The ram bushing has a rectangular tubular configuration with a ram pin hole there through.

Lastly, there is an electric hydraulic pump 96. The electric hydraulic pump has an associated reservoir contained therein. The electric hydraulic pump has a power source line 98. The electric hydraulic pump is operatively coupled to the hydraulic cylinder.

Figure 2:
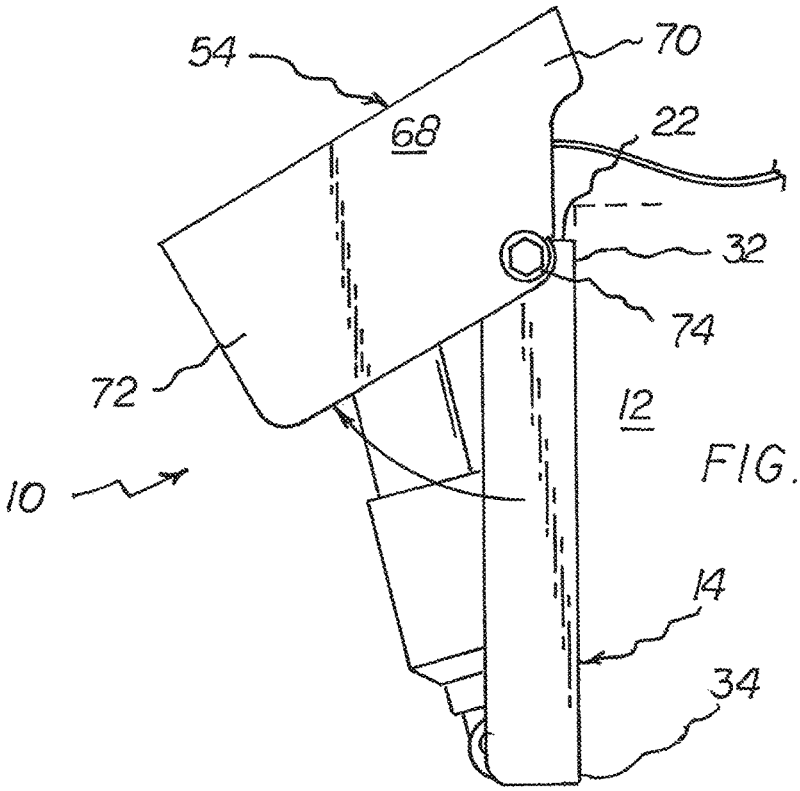
FIG. 2 is a right side elevational view of the invention in the tilted orientation.
Figure 3:
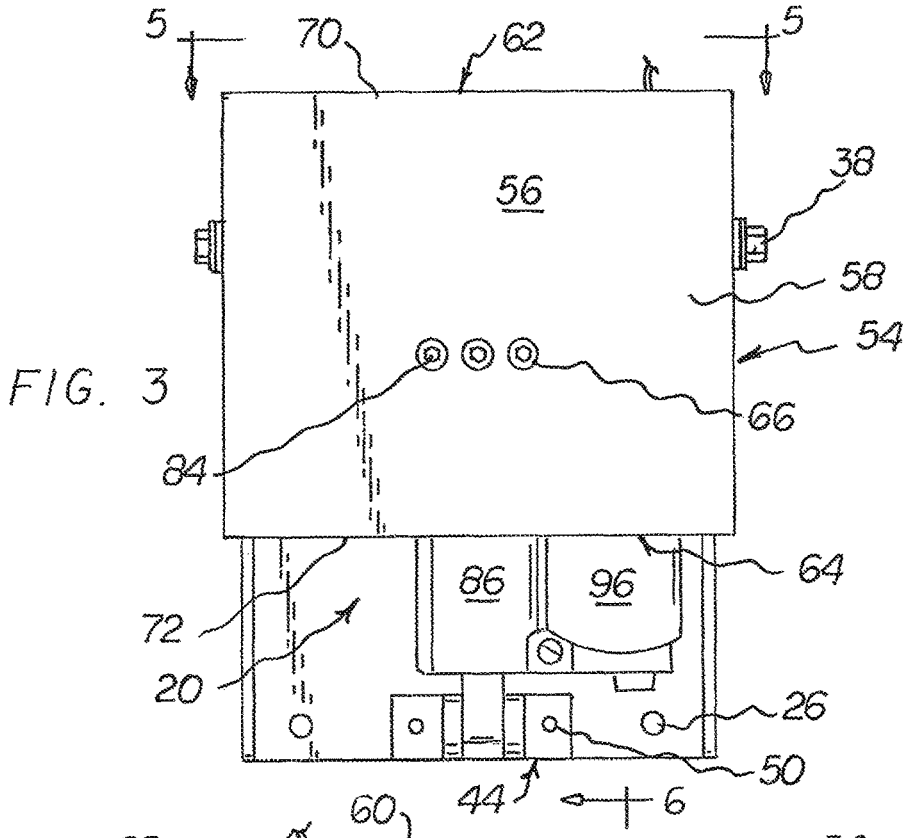
FIG. 3 is a view taken along line 3-3 of FIG. 1.
Figure 4:
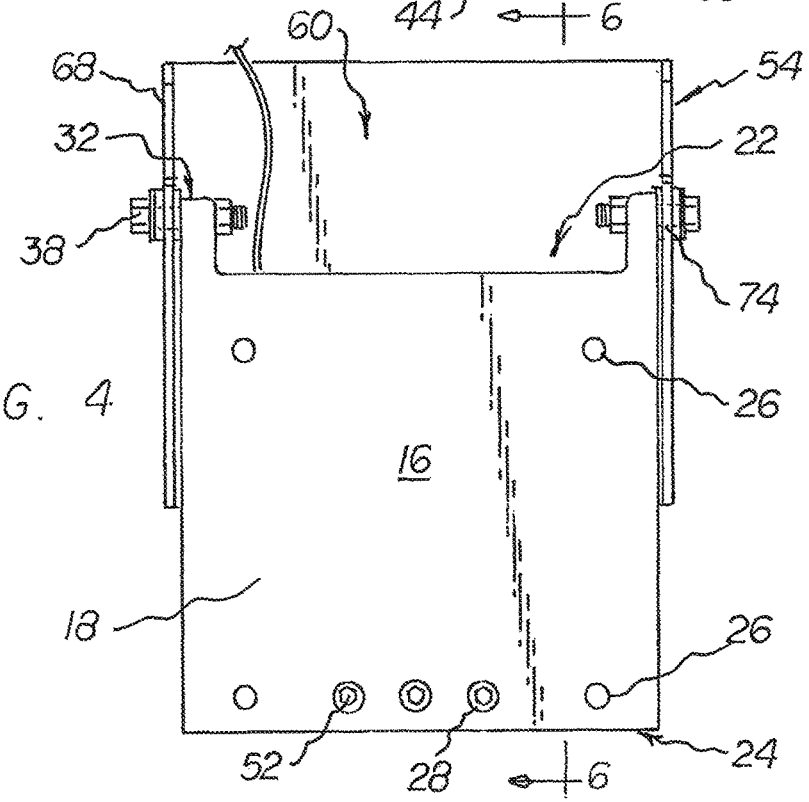
FIG. 4 is a view taken along line 4-4 of FIG. 1.
Figure 5:
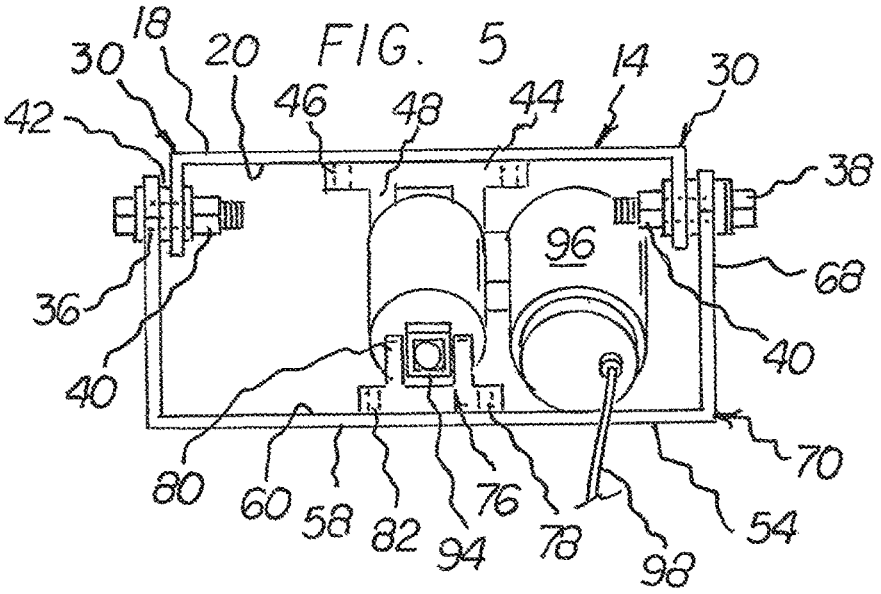
FIG. 5 is a view taken along line 5-5 of FIG. 3.
Figure 6:
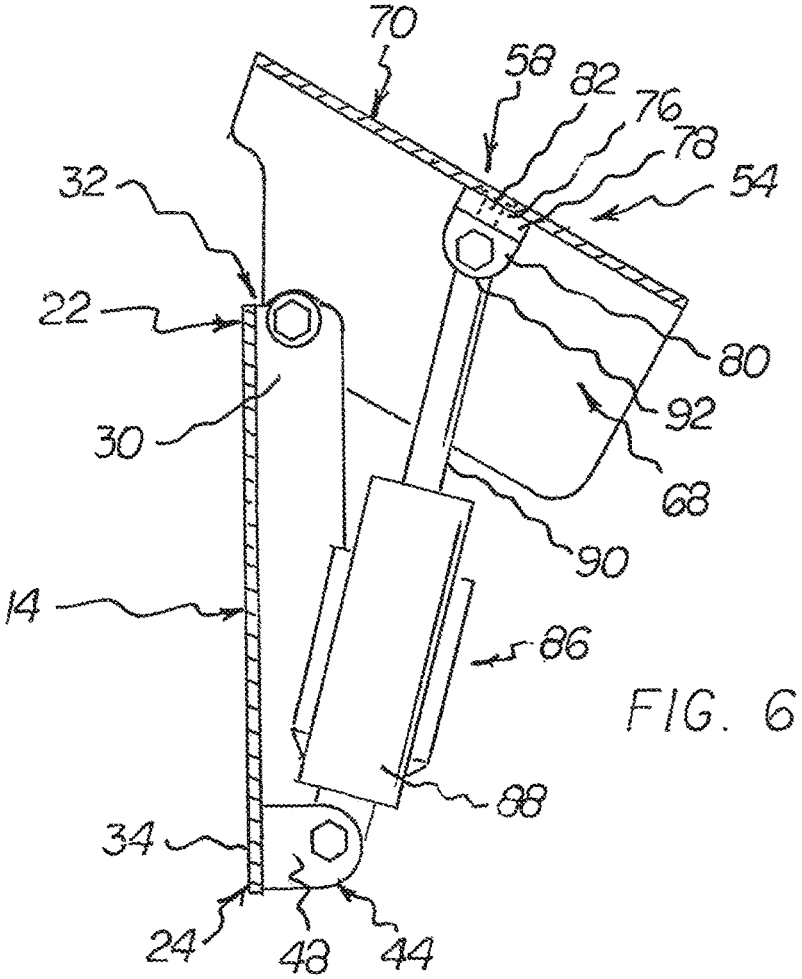
FIG. 6 is a view taken along line 6-6 of FIG. 4.

In operation the outboard motor is mounted on the motor portion of the invention. When it is necessary to tilt, or elevate the propeller of the outboard motor, the electric hydraulic pump is actuated, which extends the hydraulic cylinder, forcing the ram upwards, as shown in FIG. 2. The upwards movement of the ram pushes the motor portion into an elevated, and angle position, relative to the transom portion. A user may then lower the motor to the running orientation, as shown FIG. 1, to resume travel.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A hydraulic tilt and trim device, comprising, in combination:

a transom portion having a transom plate, the transom plate having a transom surface and a rearward surface with a thickness there between, the transom plate having an upper end and a lower end, with the upper end and lower end being continuous;

a hydraulic cylinder base support bracket coupled to the transom surface of the transom plate;

a motor portion having a motor plate, the motor plate having a motor surface and a forward surface with a thickness there between, the motor plate having upper end and a lower end, with the motor plate upper end and motor plate lower end being continuous;

a hydraulic cylinder ram support bracket being coupled to the motor plate;

a hydraulic cylinder having a base and a ram;

the hydraulic cylinder ram having a ram bushing, the ram bushing having a rectangular tubular configuration with a ram pin hole there through; and an electric hydraulic pump, the electric hydraulic pump being operatively coupled to the hydraulic cylinder, the electric hydraulic pump having an associated reservoir contained therein, the electric hydraulic pump having a power source line.

2. The hydraulic tilt and trim device as described in claim 1 with the device further comprising:

the transom portion having two oppositely located rearward extensions; and the motor portion having two oppositely located forward extensions.

3. The hydraulic tilt and trim device as described in claim 2 with the device further comprising:

the transom portion rearward extensions each having an upper end and a lower end;

the hydraulic cylinder base support bracket having a transom plate rearward surface mount and a pair of rearwardly disposed mounting tabs;

the motor portion forward extensions each having an upper end and a lower end, with the upper end and lower end of each forward extension being continuous; and the hydraulic cylinder ram support bracket having a motor plate forward surface mount and a pair of forwardly disposed mounting tabs.

4. The hydraulic tilt and trim device as described in claim 3 with the device further comprising:

the transom plate having a plurality of transom mounting holes there through, the transom plate having a plurality of hydraulic cylinder base support bracket mounting holes there through, each rearward extension of the transom portion having upper end having a pivot hole there through with there being an associated pivot bolt for each pivot hole, each pivot bolt having an associated pivot bolt nut and an associated pivot bolt spacer;

the hydraulic cylinder base support bracket having a transom plate rearward surface mount having a plurality of threaded mounting holes there through;

the motor plate having a plurality of hydraulic cylinder ram support mounting holes there through;

the upper ends of the motor portion forwardly disposed extensions each having a pivot hole there through which is sized to receive the pivot bolt; and the hydraulic cylinder ram support bracket motor plate forward surface mount having a plurality of threaded mounting holes there through.

5. The hydraulic tilt and trim device as described in claim 4 with the device further comprising:

transom plate having a generally flat rectilinear configuration;

each of the mounting holes through the hydraulic cylinder base support bracket transom plate rearward surface mount having an associated hydraulic cylinder base support bracket rearward surface mount bolt;

the motor plate having a generally flat rectilinear configuration; and the hydraulic cylinder ram support motor plate forward surface mount mounting holes through the hydraulic cylinder ram support motor plate forward surface mount each having an associated hydraulic cylinder ram support forward surface mount bolt.

6. The hydraulic tilt and trim device as described in claim 5 with the device further comprising:

the transom portion having a generally C-shaped configuration; and the motor portion having a generally C-shaped configuration.

7. The hydraulic tilt and trim device as described in claim 6 with the device further comprising the hydraulic cylinder ram having a ram pin hole there through, the hydraulic cylinder ram being coupled to the hydraulic cylinder ram support bracket and the hydraulic cylinder base being coupled to the hydraulic cylinder base support bracket.

8. The hydraulic tilt and trim device as described in claim 7 with the device further comprising:

the transom portion being fabricated of rigid material;

the hydraulic cylinder base support bracket fabricated of rigid material;

the motor portion being fabricated of rigid material; and the hydraulic cylinder ram support bracket fabricated of rigid material.

* * * * *